US005697484A

United States Patent [19]

Yeh

[11] Patent Number: 5,697,484

[45] Date of Patent: Dec. 16, 1997

[54] ELECTRONIC COIN-COLLECTING MECHANISM

[76] Inventor: Young-Chin Yeh, 2F, No. 70, Wu Hua Street, San Choung City, Taipei Hsien, Taiwan

[21] Appl. No.: 265,737

[22] Filed: Jun. 27, 1994

[51] Int. Cl.[6] ..... G07D 5/08

[52] U.S. Cl. ..... 194/318

[58] Field of Search ..... 194/318

[56] References Cited

U.S. PATENT DOCUMENTS 4,437,558 3/1984 Nicholson et al. ..... 194/320 X 5,056,644 10/1991 Parker ..... 194/318

*Primary Examiner*—F. J. Bartuska

*Attorney, Agent, or Firm*—Bacon & Thomas

[57] ABSTRACT

Disclosed is an electronic coin-collecting mechanism including a vertically movable sensor to examine qualified coins inserted into the mechanism so as to actuate a game on which the mechanism is mounted. The sensor consists of a first and a second oscillating coils and an inductive coil sandwiched between them, forming a first slot way and a second slot way at a lower portion of the sensor. The sensor can be set or reset to examine selected coin specifications simply by lifting it to allow a selected coin to be put into the second slot way and then letting down the sensor again. Therefore, the electronic coin-collecting mechanism is conveniently-applicable to any type of coin and may effectively detect any disqualified coin and discharges the same.

1 Claim, 10 Drawing Sheets

2

ELECTRONIC COIN-COLLECTING MECHANISM

BACKGROUND OF THE INVENTION

Most of the conventional electronic games are mounted with a coin-collecting mechanism. Through a coin slot on the game, a user inserts specified coin or coins in advance to enjoy the game. The coin-collecting mechanism in earlier stage has so simple structure that the slot machine with such mechanism can be easily actuated just by inserting coin(s) into the slot thereon. Some naughty kids or opportunists take the advantage of this simple structure to actuate the game by inserting some non-coin round metal sheet, flat and long copper plate, or other similar articles, enjoy the game without paying the regular money. This causes, of course, considerable troubles to the proprietors of such electronic games. There was a much precise electronic coin-collecting mechanism 1 developed by the industry to solve this problem. As shown in FIG. 1, the electronic coin-collecting mechanism 1 has a coin slot 11 through which coins are inserted and then fall down along an inclined slideway 12 behind the coin slot 11. An adjustable sensor 13 is provided at the bottom end of the slideway where a turn exists to examine all the coins passing therethrough. If a formal coin is detected, a relay 14 (not shown) is electrically connected to open a gate 140 for the coin to pass through. In this examination procedure, the sensor 13 is regulated to a high sensitive level to effectively detect the correct material, size, and thickness of the coins pass the sensor 13. Any informal coin or other instituted article would not make the relay 14 to open the gate 140 and would be discharged from a coin discharge slot 15. Such mechanism effectively stops the improper behavior of those opportunists. However, since the sensor 13 for such mechanism 1 uses inductive coils to precisely regulate its detection function, it is very uneasy or complicated to adjust the originally regulated sensor 13 when the shape, size or material of the coin to be detected is to be changed. To save the trouble of regulating the sensor 13, the proprietor usually uses a new set of coin-collecting mechanism with a sensor 13 regulated to match with the changed coin specifications to substitute for the old mechanism. That is, each of the coin-collecting mechanism 1 is actually exclusive for only one type of coin and can not be adjusted for application to different coins. The benefit provided by this type of coin-collecting mechanism is therefore limited and need improvement by the industry.

SUMMARY OF THE INVENTION

It is therefore a primary object of the present invention to provide an electronic coin-collecting mechanism which has simple structure and has a sensor which can be easily set to examine any selected type of coin passing through a main slideway of the mechanism.

A coin-collecting mechanism according to the present invention is a coin collector and counter applicable to any shape, size, and thickness of coin without the need to replace the mechanism whenever the coin to be collected is changed. The coin-collect mechanism of the present invention comprises a front panel, two adequately spaced side walls disposed behind the front panel to form therebetween a passage for coins, an inserting recess formed at a proper position in mid way of the side walls, and a set of sensor vertically movably disposed in the inserting recess. The sensor is so structured that it forms a first slot way and a second slot way at a lower portion thereof. The sensor can be easily set or reset by lifting it to allow a selected coin to be put in the second slot way and then letting down it again. After the sensor is set, only coins having the same specifications as those of the coin put in the second slot way may successfully pass through the first slot way to actuate a game on which the coin-collecting mechanism is mounted. Any disqualified coin passing the first slot way would not actuate the game and be discharged from a coin-discharge slot.

DETAILED DESCRIPTION OF THE PREFERRED EMBODIMENT

Figure 1:
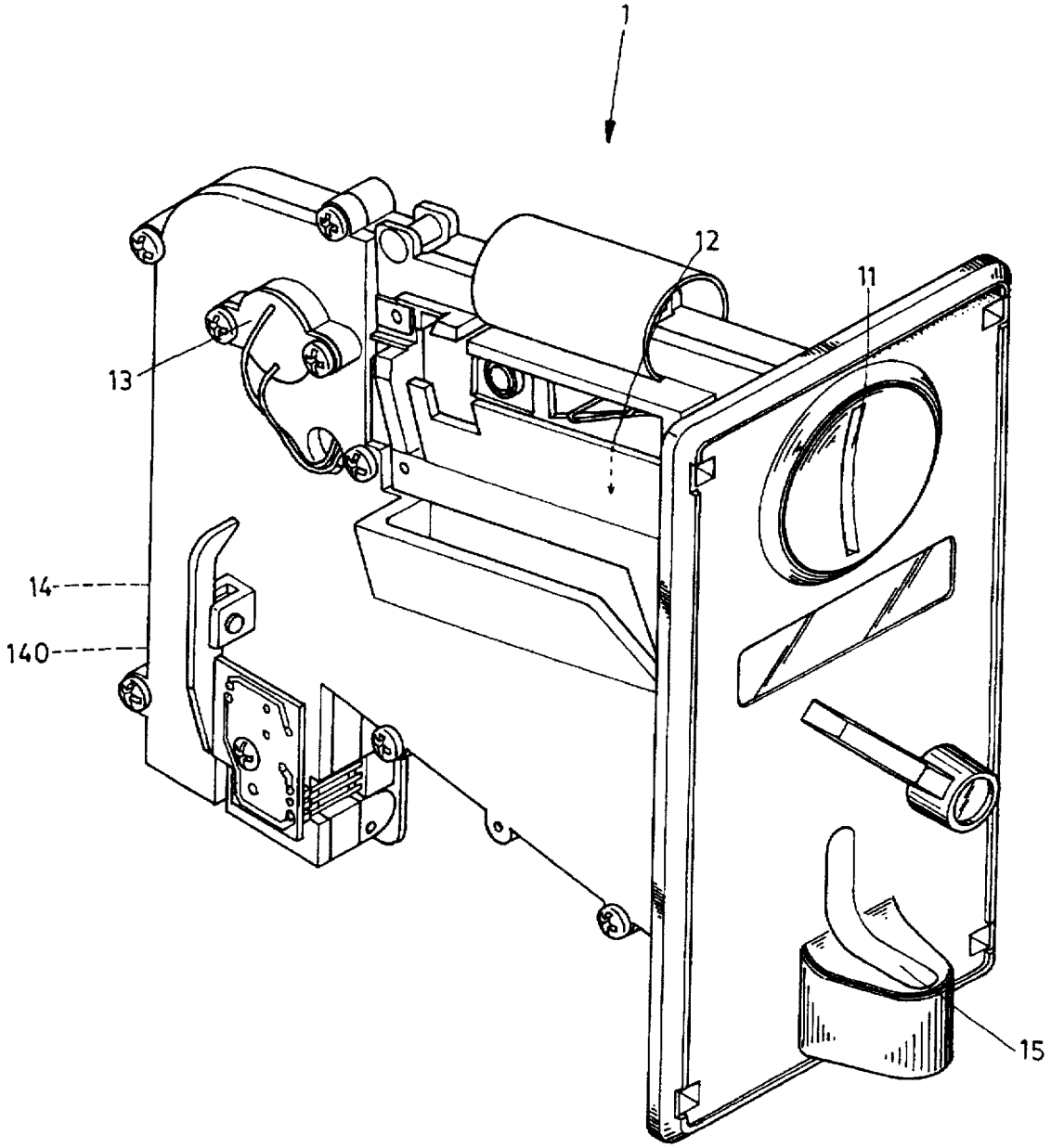
FIG 1 (prior art)
FIG. 1 is a perspective view of a conventional electronic coin-collecting mechanism.
Figure 2:
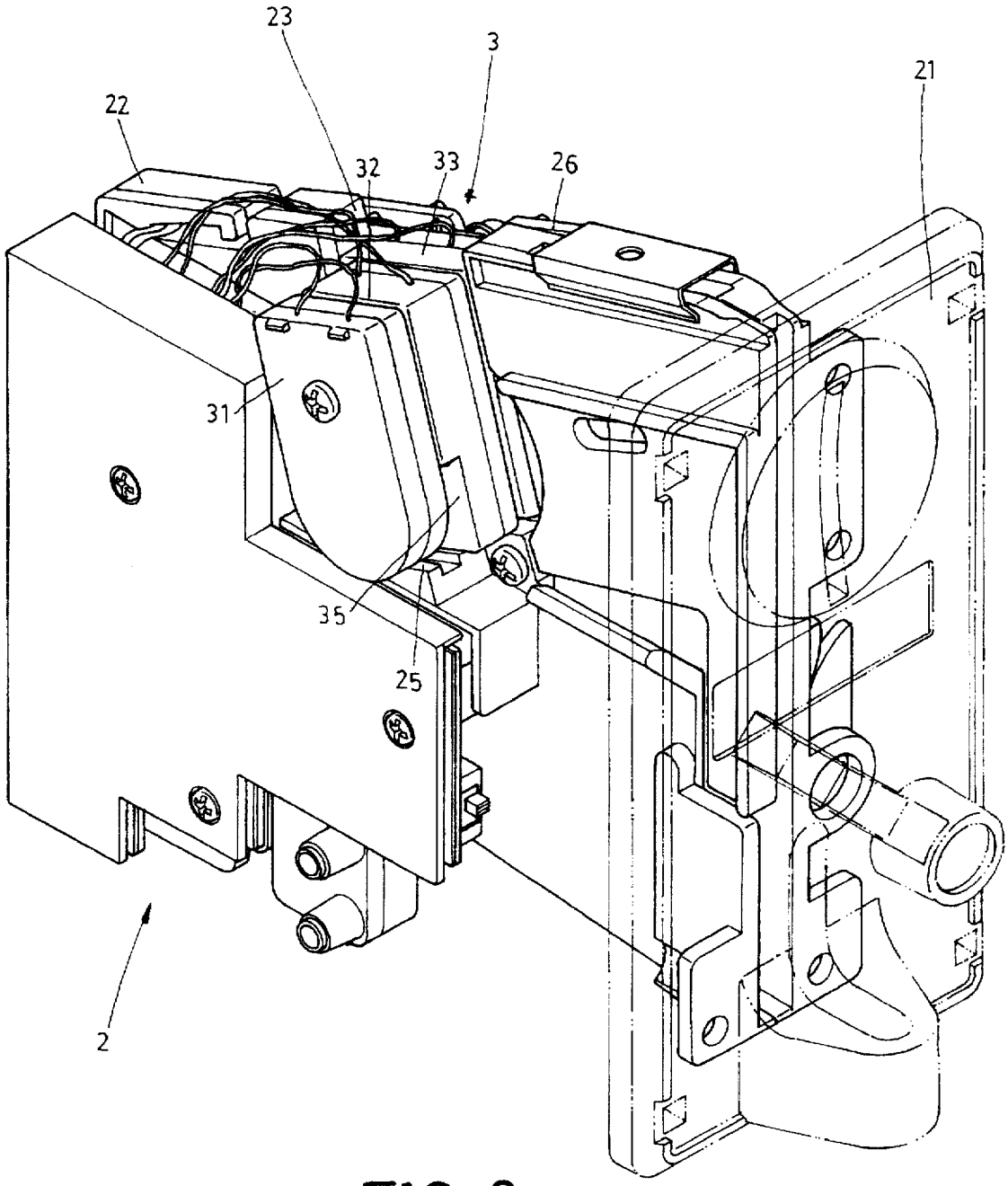
FIG. 2 is a left side perspective view of a coin-collecting mechanism according to the present invention.
Figure 3:
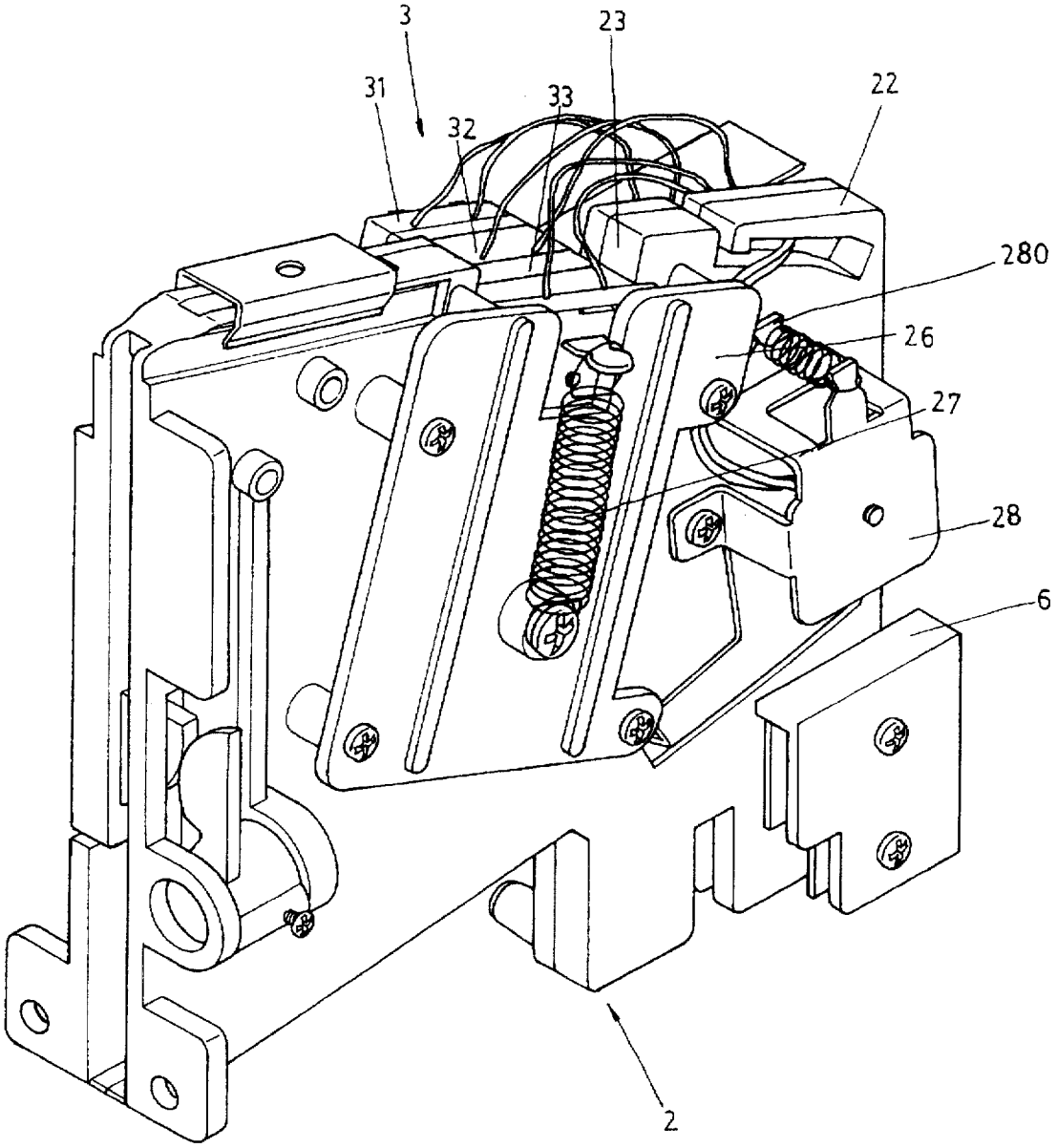
FIG. 3 is a right side perspective view of the coin-collecting mechanism according to the present invention.
Figure 4:
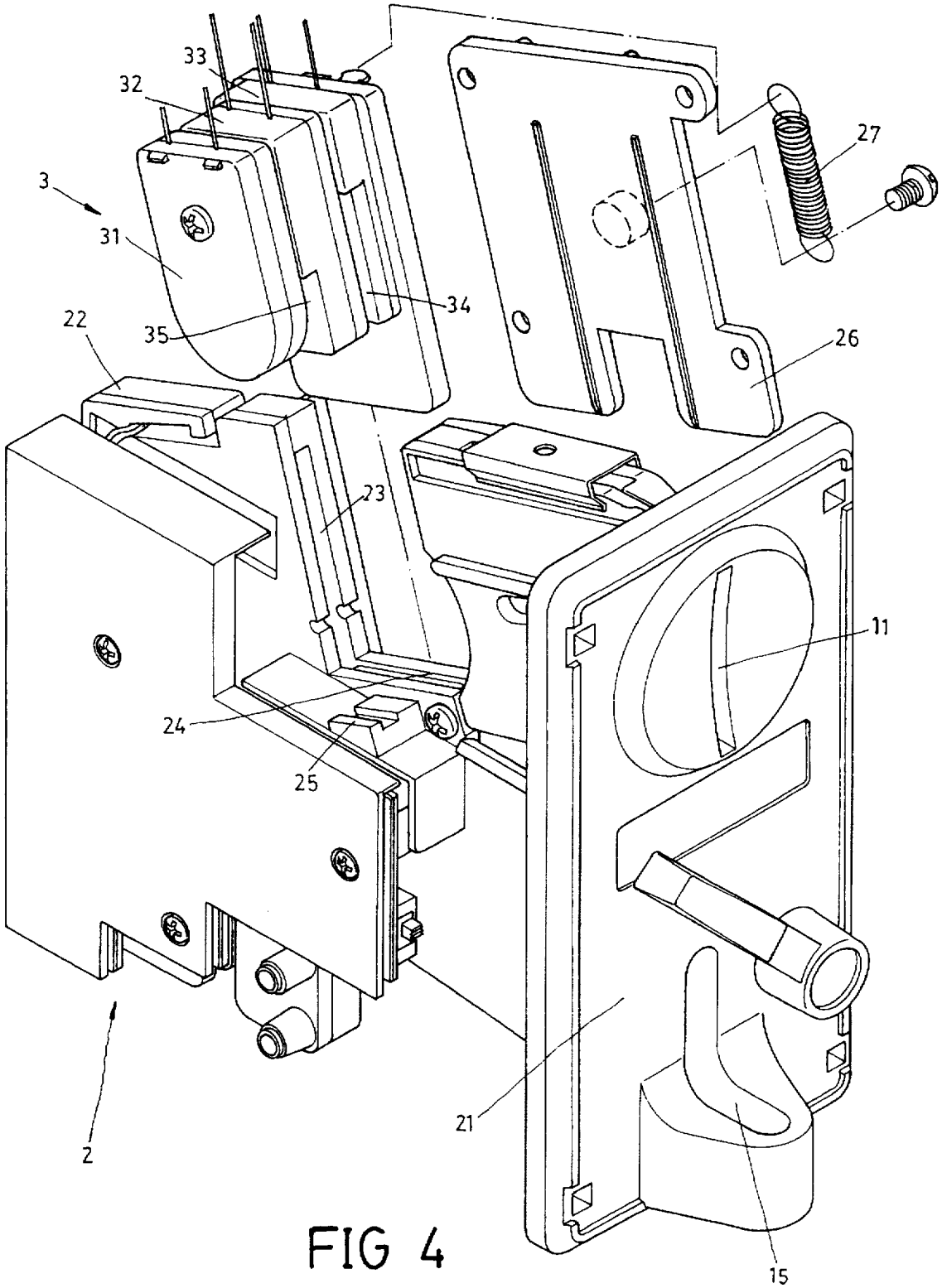
FIG. 4 is an exploded perspective of the coin-collecting of the present invention.

Please refer to FIGS. 2, 3, and 4. The present invention is a coin-collecting mechanism 2 comprising a front panel 21 having a coin-insertion slot 11 and a coin-discharge slot 15 provided thereon, two adequately spaced side walls 22 disposed behind the front panel 21 to form therebetween a passage for coins, an inserting recess 23 formed at a proper position in mid way of the side walls 22, a set of sensor 3 vertically movably disposed in the inserting recess 23, a relay 28, and a counter 6.

Figure 5:
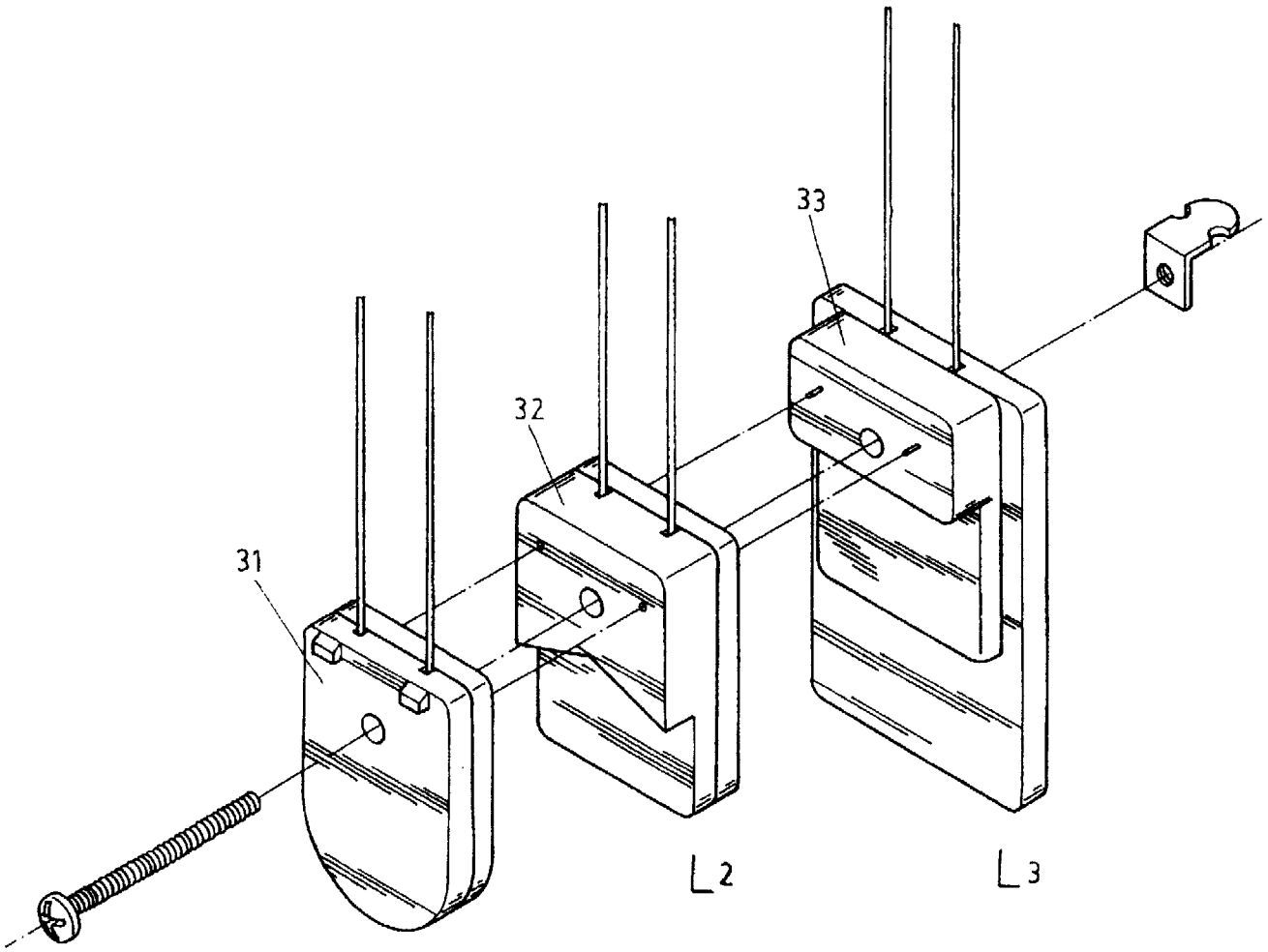
FIG. 5 is a disassembled perspective of the sensor used in the present invention.
Figure 6:
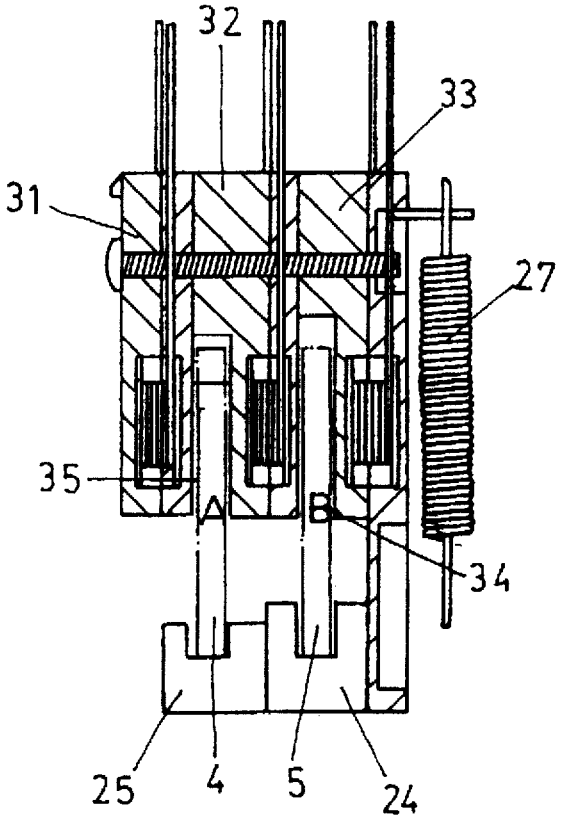
FIG. 6 is a sectional view showing the assembled sensor of FIG. 5.

Please refer to FIGS. 4, 5 and 6, the sensor 3 consists of a first oscillating coil L1 (31), a second oscillating coil L3 (33), and an inductive coil L2 (32) sandwiched between the first and the second oscillating coils L1, L3 (31, 33). As shown in FIG. 6, after the inductive coil L2 is sandwiched between the oscillating coils L1, L3 by means of a bolt threading through an upper portion thereof, a first slot way 34 having a downward opening is formed between a lower portion of the second oscillating coil L3 (33) and the inductive coil L2, and a second slot way 35 also having a downward opening is formed between a lower portion of the first oscillating coil L1 (31) and the inductive coil L2 (32). The first slot way 34 corresponds to an backward inclined main slideway 24 which forms a lower base of the passage formed between the two side walls 22. The second slot way 35 corresponds to a secondary slideway 25 which is a short block member disposed at one outer side of the side walls 22 in parallel to the main slideway 24. As shown in FIGS. 3 and 4, a locating plate 26 is fixed to one lateral side of the second oscillating coil L3 (33) to define a vertical slide path for the sensor 3. Moreover, a compression spring 27 is connected between the second oscillating coil L3 (33) and the locating plate 26 to generate a downward spring force relative to the sensor 3. By this way, the sensor 3 can be lifted for a coin A (4) to dispose in the second slot way 35 between the sensor 3 and the secondary slideway 25 to set the specifications of coin the sensor 3 shall examine when a coin passes through the first slot way 34 between the sensor 3 and the main slideway 24.

Figure 7:
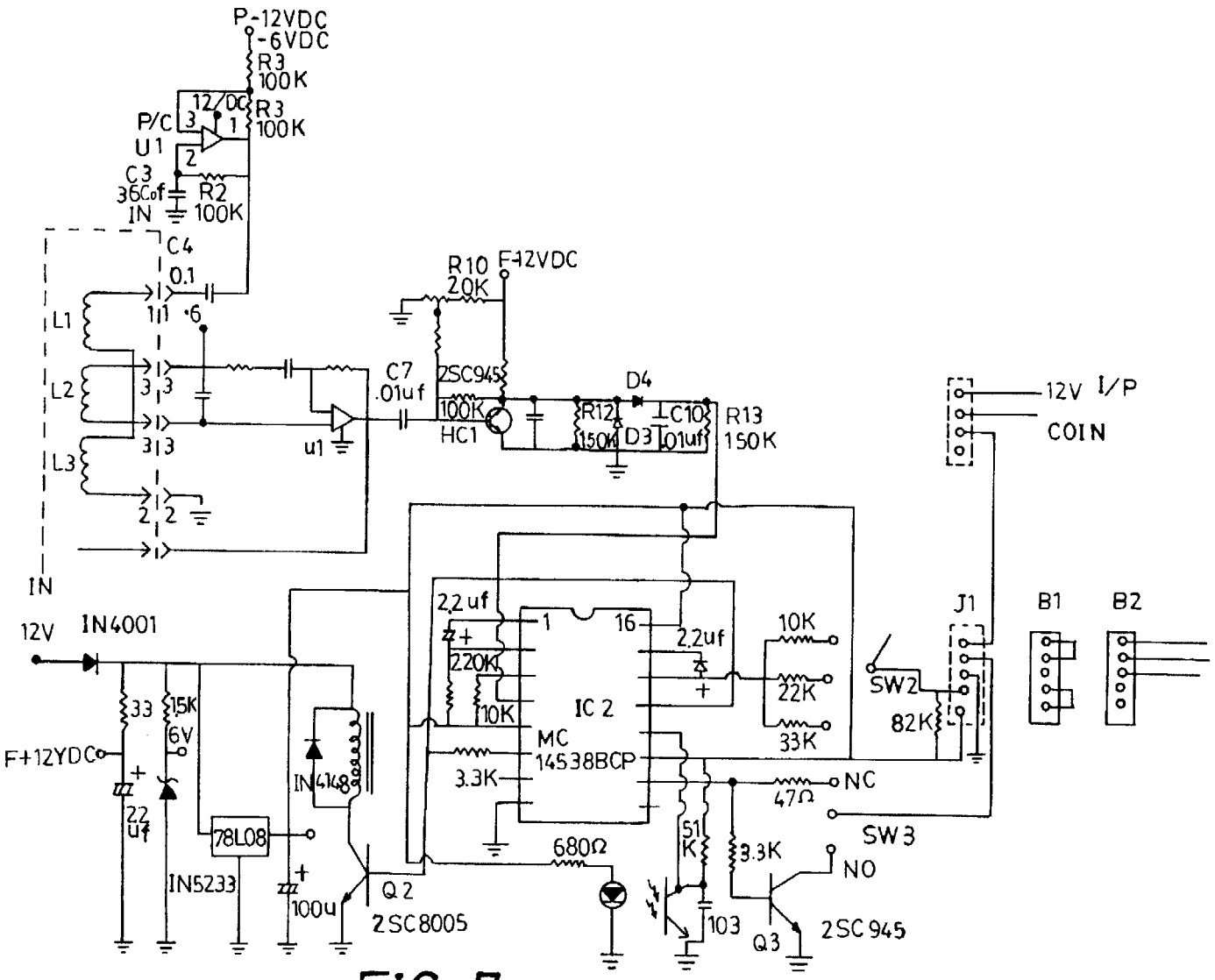
FIG. 7 is a circuit diagram illustrating the electronic structure of the present invention.
Figure 10:
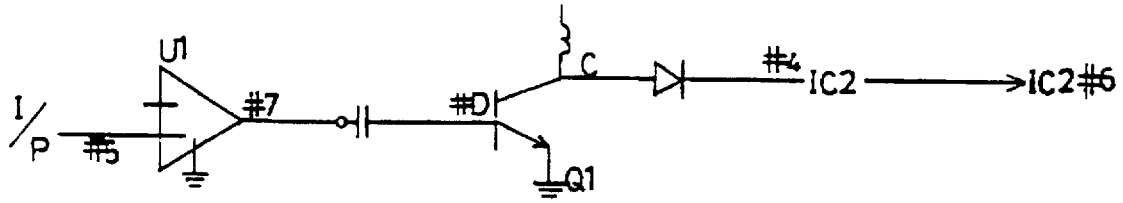
FIG. 10 is a partial schematic diagram according to the present invention.

FIGS. 7 and 10 are circuit diagrams of the present invention. From the diagram, it can be seen that after a selected coin A (4) is disposed between the second slot way 35 between the first oscillating coil L1 (31) and the inductive coil L2 (32), the sensor 3 detects a high-level output: IC, U1, and #5 has a low-level input, and when U1, O/P #7 is high, then the Q1#B is also high; when Q1#C is low-level, i.e., IC2 #4 is low, then IC2 #B has a low-level output which causes Q2#B to be low, and therefore Q2 is inactive; that is, if only the second slot way 35 has a selected coin A (4) therein, the relay 28 would not be actuated to open a gate 280 for collecting coins. Similarly, if a coin having first slot way 34 between the sensor 3 and the main slideway 24, the relay 28 would not be actuated to open the gate 280, neither, and the coin is discharged from the coin-discharge slot 15. Reversely, if a coin B (5) having the same material, shape, size, and thickness as those of the selected coin A (4) disposed in the second slot way 35 passes the first slot way 34 between the sensor 3 and the main slideway 24, the inductive coil L2 (32) shall induce a low level putput, that is, the U1 #5 I/P is low, and the U1 #7 is low which causes Q1#B to be low, and therefore, Q1#C is high which causes IC2 #4 to be high, IC2 #B to be high, causing Q2#B to be high. At this point, the Q2 is actuated to bring the relay 28 to act and open the gate 280 for the coin B (5) to pass and contact the counter 6 before a game controlled by the coin-collecting mechanism can be proceeded.

In brief, when there is not any selected coin A (4) disposed between the second slot way 35 and the secondary slideway 25, the two slot ways 34, 35 have the same inductance value and the outputs thereof are two equal voltages with different polarities. The two voltages offset with each other and therefore, the inductive output of the L2 (32) is low-level (0). However, when a selected coin A (4) enters the setting position between the second slot way 35 and the secondary slideway 25, the inductive output of the L2 (32) is high-level (1), and the two slot ways 34, 35 lose their balanced inductance value which disables the Q2 and therefore, the relay 28 would not open the gate 280. At this point, if any coin having specifications different from those of the coin A (4) passes the first slot way 34, the sensor 3 shall response the same as it will do in the above-mentioned condition of unbalanced inductance values, and the disqualified coin is discharged from the coin-discharge slot 15. On the contrary, if a qualified coin B (5) completely the same as the coin A (4) used to set the sensor 3 passes between the first slot way 34 and the main slideway 24, the L2 (32) detects a similar outputs, and the two slot ways 34, 35 regain a balanced inductance value. This regained balanced inductance value actuates the Q2 and accordingly the relay 28 to open the gate 280. That is, the sensor 3 can correctly and effectively examine and judge the inserted coins for their qualification.

Figure 8:
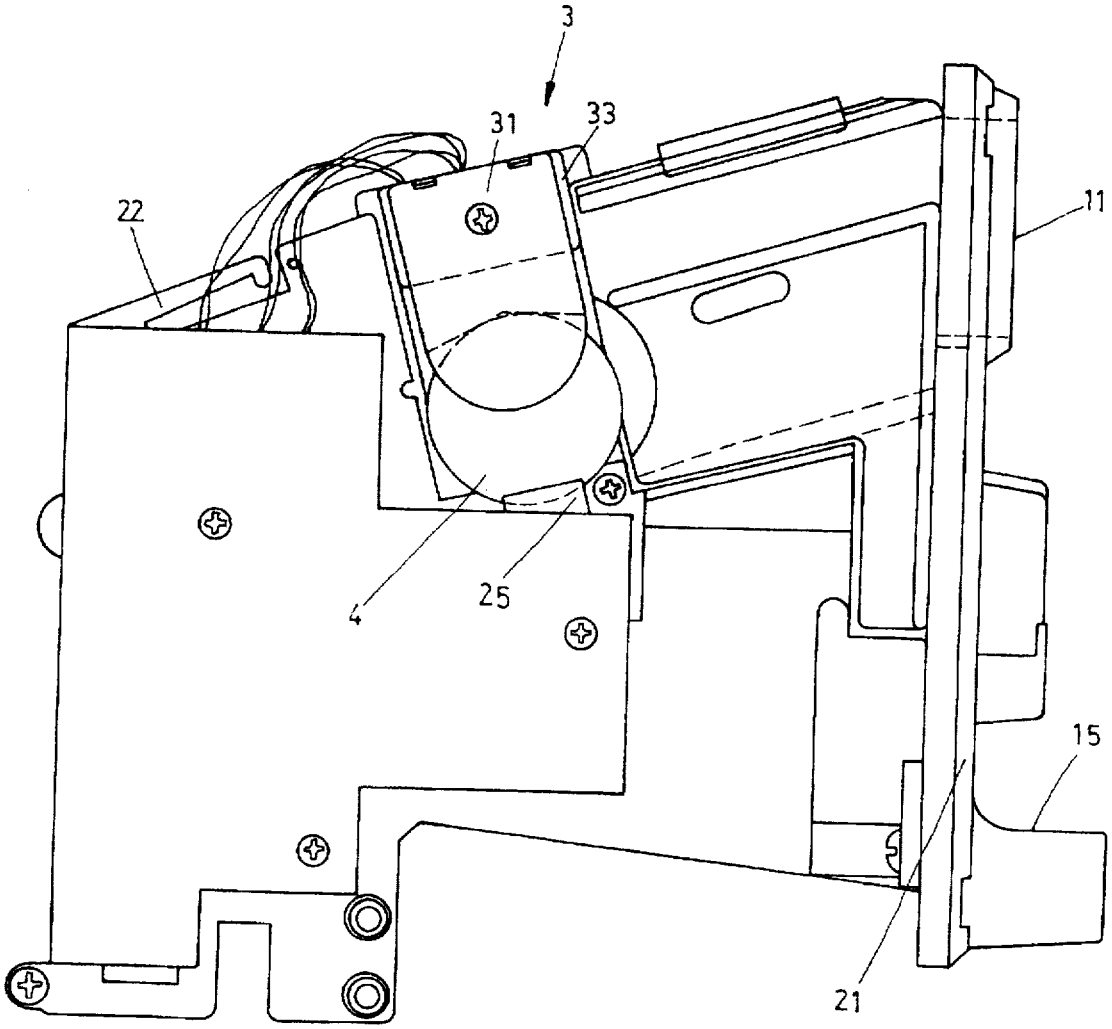
FIG. 8 is a side view of the present invention wherein the slot way is set to collect a large-size coin.
Figure 9:
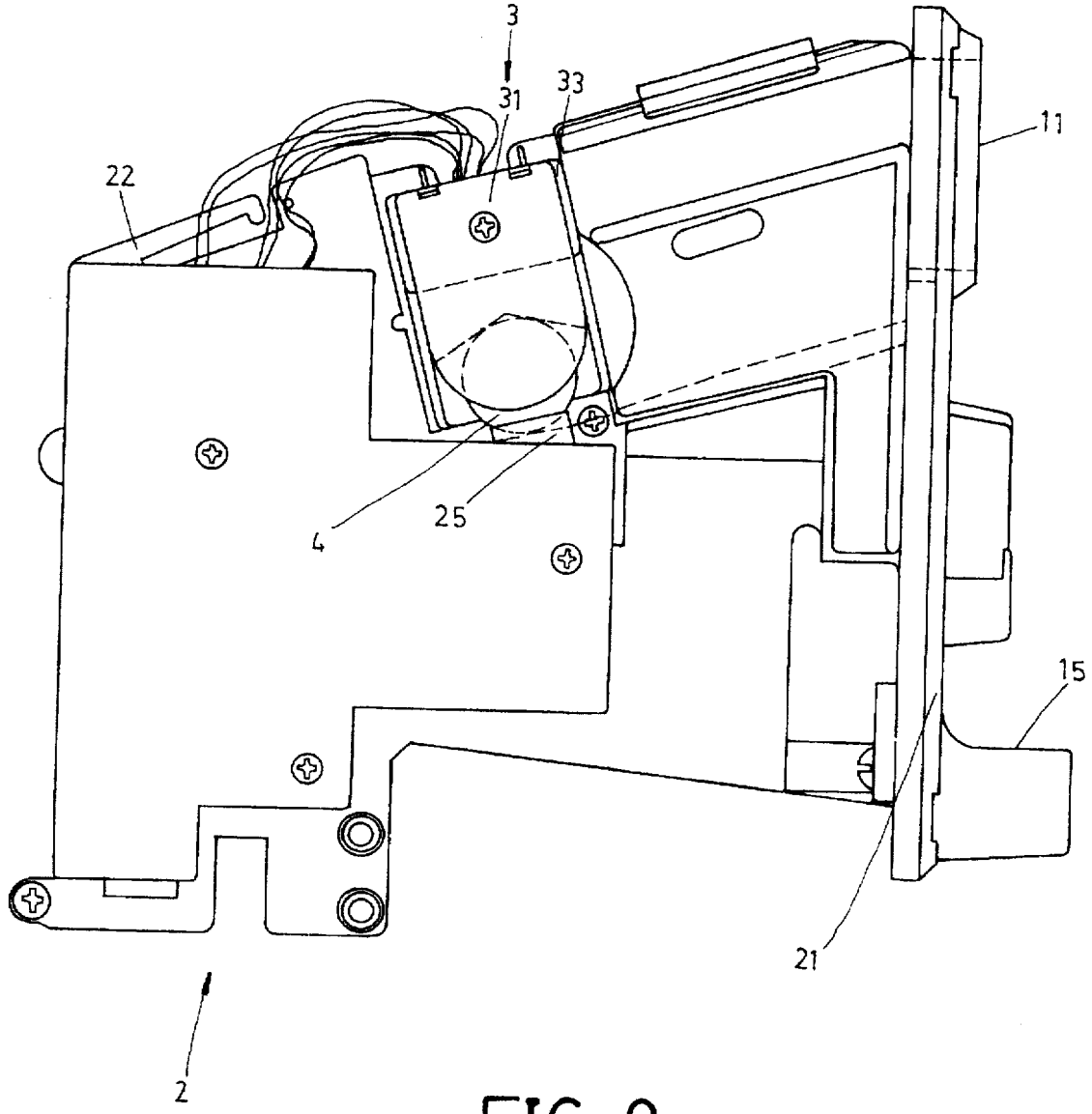
FIG. 9 is a side view of the present invention wherein the slot way is set to collect a small-size coin.

Under the action of the compression spring 27, the sensor 3 has the ability to vertically slide along the locating plate 26. To set the sensor 3, just slightly lift the sensor 3 and place a selected coin A (4) between the second slot way 35 and the secondary slideway 25, or to reset the sensor 3, just remove the old coin A (4) in the second slot way 35 and put another selected coin A (4) into the same slot way 35. Then, allow the sensor 3 to slide downward along the locating plate 26 under the recovery force of the compression spring 27 acted on the sensor 3. As shown in FIG. 8, when a large coin A (4) is placed in the setting position, that is, the space between the second slot way 35 and the secondary slideway 25, the relay 28 is actuated to only allow large coins B (5) having the same specifications as the coin A (4) in the setting position to pass through the gate 280 to actuate the game. Or, as shown in FIG. 9, when a small coin A (4) is placed in the setting position, the relay 28 is actuated to only allow small coins B (5) having the same specifications as the coin A (4) in the setting position to pass through the gate 280 to actuate the game. The entire setting or resetting procedure of the sensor 3 can be easily and conveniently completed just by lifting the sensor 3, selecting a desired coin A (4), putting the same in the setting position in the coin-collecting mechanism 2, and let down the sensor 3 again, without any other precise adjusting operation.

What is claimed is:

1. An electronic coin-collecting mechanism comprising; a from panel having a coin insert slot and a coin discharge slot; two spaced side walls disposed behind said front panel to form therebetween a passage for inserted coins; a generally "U"-shaped inserting recess formed in and opening through upper edges of said side walls; a locating plate fixedly attached to one of said side walls so as to cover said inserting recess; a sensor substantially vertically movably connected to said locating plate and extending through said recess wherein said sensor comprises a first oscillating coil, a second oscillating coil, and an inductive coil sandwiched between said two oscillating coils; said first oscillating coil and said inductive coil together defining therebetween a first slot way aligned with an inclined main slideway forming a base of said passage defined by said two side walls of said coin-collecting mechanism; and said second oscillating coil and said inductive coil together defining therebetween a second slot way aligned with a secondary slideway which is a short block member disposed at one lateral side of said side walls in parallel to said main slideway; and a spring connected between the sensor and the locating plate to bias the sensor toward a first position relative to the coin passage, such that said sensor can be set to examine a selected coin specification simply by moving said sensor along said locating plate to allow a selected coin to be put between said second slot way and said secondary slideway whereby said sensor under the recovery force of said spring will hold the selected coin in a desired position.

* * * * *